US011779145B2

(12) United States Patent
Marchant

(10) Patent No.: US 11,779,145 B2
(45) Date of Patent: Oct. 10, 2023

(54) MODULAR CHRISTMAS TREE

(71) Applicant: SCALABLE DESIGNS LIMITED, Reading (GB)

(72) Inventor: Michael James Marchant, Oxfordshire (GB)

(73) Assignee: SCALABLE DESIGNS LIMITED

( * ) Notice: Subject to any disclaimer, the term of this patent is extended or adjusted under 35 U.S.C. 154(b) by 142 days.

(21) Appl. No.: 17/612,990

(22) PCT Filed: May 13, 2020

(86) PCT No.: PCT/EP2020/063361
§ 371 (c)(1),
(2) Date: Nov. 19, 2021

(87) PCT Pub. No.: WO2020/234091
PCT Pub. Date: Nov. 26, 2020

(65) Prior Publication Data

US 2022/0211204 A1 Jul. 7, 2022

(30) Foreign Application Priority Data

May 20, 2019 (GB) ..... 1907060

(51) Int. Cl.
*A47G 33/06* (2006.01)

(52) U.S. Cl.
CPC ..... *A47G 33/06* (2013.01)

(58) Field of Classification Search
CPC ..... A47G 33/06
USPC ..... 428/20
See application file for complete search history.

(56) References Cited

U.S. PATENT DOCUMENTS 3,865,676 A 2/1975 Bogart et al.
4,415,953 A 11/1983 Shepherd
5,488,549 A 1/1996 Miller et al.

FOREIGN PATENT DOCUMENTS

DE 19521202 A1 12/1996
WO 2011058667 A1 5/2011

OTHER PUBLICATIONS

Jubiltree, "The Jubiltree Company, LLC" Facebook Page with selected pictures, 2012-2017, p. 1-5; Accessed at https://www.facebook.com/jubiltree/. (Year: 2017).*
The above documents were cited in the IPRP dated Nov. 16, 2021 a copy of which is enclosed, that issued in the corresponding PCT Application No. PCT/EP2020/063361.
(Continued)

*Primary Examiner* — Mark Ruthkosky
*Assistant Examiner* — Julia L Rummel
(74) *Attorney, Agent, or Firm* — Cowan, Liebowitz & Latman, P.C.; Mark Montague

(57) ABSTRACT

The present invention provides a modular Christmas tree (10) comprising three or more sides (12) that rise from a floor to give the tree a tapering shape, and central support structures (14*b*) that extend outwardly to support the sides. Each side (12) comprises elongate pieces (16*a-c*) joined together with connectors that allow the series of elongate pieces to be separated for storage of the disassembled Christmas tree. Each central support structures includes a hub that supports each side, and may also comprise spokes that extend from the hub to each side. The hubs, spokes and sides are joined by connectors that allow the tree to be disassembled for storage.

17 Claims, 7 Drawing Sheets

(56) References Cited

OTHER PUBLICATIONS

Some of the above documents were cited in the ISR dated Jul. 22, 2020 a copy of which is enclosed, that issued in the corresponding PCT Patent Application No. PCT/EP2020/063361.
Some of the above documents were cited in UK search report dated Nov. 5, 2019 a copy of which is enclosed, that issued in corresponding GB Patent Application No. GB1907060.6.

* cited by examiner

Fig. 17
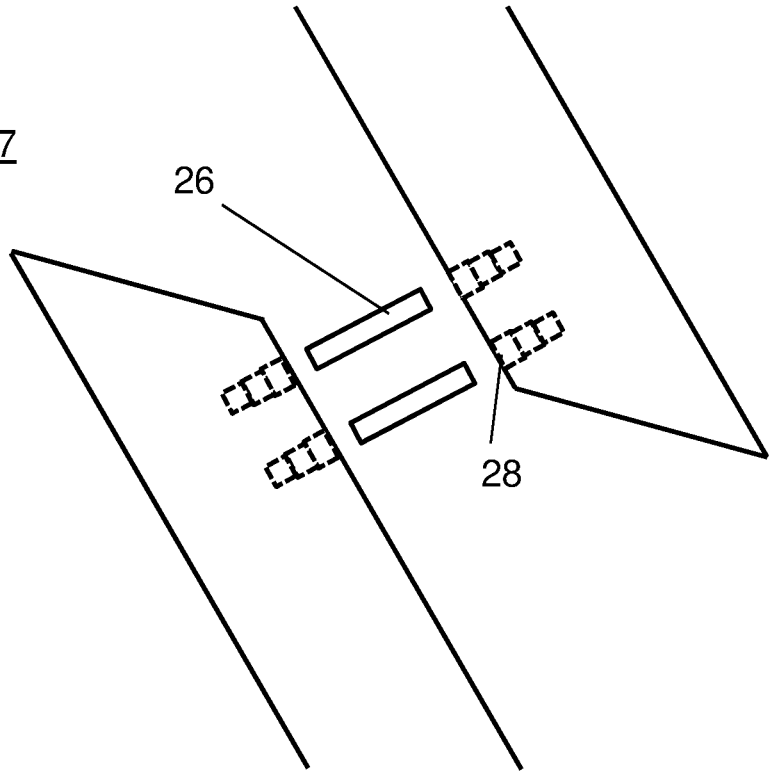
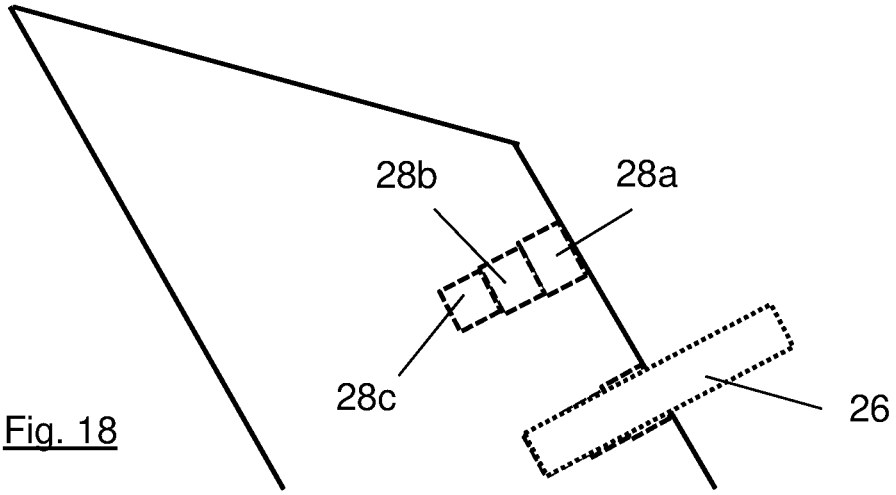
Fig. 18

MODULAR CHRISTMAS TREE

FIELD OF THE INVENTION

The present invention relates to a modular Christmas tree. In particular, the present invention relates to a modular Christmas tree comprising parts that may be assembled to form an artificial Christmas tree, and subsequently disassembled and stored compactly.

BACKGROUND TO THE INVENTION

Artificial Christmas trees traditionally comprise a stand, an artificial trunk and artificial branches provided with artificial needles so as to mimic the appearance of a real Christmas tree. Usually the artificial Christmas tree can be at least partly disassembled or folded into a more compact configuration for storage. However, such traditional artificial Christmas trees are still bulky in their stored states and require a substantial volume. This problem is exacerbated by the seasonal nature of Christmas trees, as they are stored for around eleven months of the year. In addition, such artificial Christmas trees make extensive use of PVC which is not environmentally friendly.

Some artificial Christmas trees have non-traditional designs. For example, U.S. Design Pat. No. 832133 shows an artificial Christmas tree with a base, a central vertical support akin to a trunk, and a series of tiers that figuratively mimic branches. Each tier comprises a set of three battens arranged in the shape of a six-armed asterisk when viewed from above, with their centres crossing at the vertical support. The tiers are spaced apart vertically, and the tiers get progressively wider from top to bottom to give the artificial Christmas tree a tapering shape.

U.S. Design Pat. No. 624452 shows another non-traditional Christmas tree. The tree has a base, a central vertical support akin to a trunk and a series of battens placed one above another with only a small separation. The centres of the battens coincide with the vertical support and each batten is rotated slightly relative to the preceding batten to form a helical shape. The length of the battens progressively lengthens from top to bottom to give the tree a tapering shape.

SUMMARY OF THE INVENTION

Against this background, and from a first aspect, the present invention resides in a modular Christmas tree comprising three or more side structures that is configured to rise from a supporting surface such as a floor, wherein the three or more side structures are arranged obliquely to give the modular Christmas tree a tapering shape that widens from top to bottom. The tree further comprises a plurality of central support structures that extend outwardly to support the three or more side structures. The plurality of central support structures increase in width from the top to the bottom of the modular Christmas tree to follow the tapering shape of the modular Christmas tree.

Each side structure comprises a series of elongate pieces joined together with connectors that allow the series of elongate pieces to be separated for storage of the disassembled Christmas tree. The series of elongate pieces include an uppermost elongate piece, intermediate elongate pieces and a lowermost elongate piece. The elongate pieces are joined to each other by the connectors such that their ends overlap at overlapping portions to form a zigzag shape (with long legs of the zigzag running along each elongate piece and short legs of the zigzag running across the elongate pieces through the overlapping portions). The connectors are provided at the overlapping portions.

The plurality of central support structures includes an upper central support structure and one or more lower central support structures. The upper central support structure comprises an upper hub having joint surfaces disposed around its sides with a joint surface for each of the three or more side structures.

Each of the one or more lower central support structures comprises a lower hub having joint surfaces disposed around its sides with a joint surface for each of the three or more side structures. Each of the one or more lower central support structures also comprises a number of radially-extending spokes corresponding to the number of side structures. Each joint surface is joined to an end of a spoke with a connector being provided to allow the spoke to be joined to the associated joint surface of the lower hub when the tree is being assembled and separated from the associated joint surface of the lower hub when the tree is being disassembled. Each spoke supports, at its other end, an intermediate elongate piece of a side structure with a connector being provided to allow the intermediate elongate piece to be joined to the associated spoke when the tree is being assembled and separated from the associated spoke when the tree is being disassembled.

The upper central support structure may or may not comprise a number of radially-extending spokes corresponding to the number of side structures like the at least one lower central support structure. Each joint surface of the upper hub may be joined to the uppermost elongate piece of its associated side structure directly or may be joined to the uppermost elongate piece of its associated side structure indirectly via radially-extending spokes.

In this way, the modular Christmas tree employs a limited number of components held together by connectors to create a life-sized three-dimensional structure corresponding to a simplified, yet clearly identifiable Christmas tree. Moreover, the side structures of the modular Christmas tree may be equally separated in angle such that the modular Christmas tree retains its characteristic shape when viewed from any angle (for example, the tree may have five side structures arranged at 72° intervals). The components may be simple in design and assemble in a modular fashion. When assembled, the components form a sturdy structure which is of similar height to real Christmas trees (such as domestic use Christmas trees found in homes) and occupies a similar floor space. Advantageously, the disassembled components can be stored in a compact manner and occupy a volume that is considerably smaller than the storage requirement of similar-sized artificial Christmas trees.

Further optional features of the modular Christmas tree will now be described.

As mentioned above, each joint surface of the upper hub may support the uppermost elongate piece of its associated side structure with a connector being provided to allow the uppermost elongate piece to be joined directly to and separated from the associated joint surface of the upper hub. Hence, the upper central support structure may not include any spokes, in contrast with the lower central support structures. This ensures a narrow top to the modular Christmas tree, and contributes to the tapering shape of the Christmas tree.

Alternatively, the upper central support structures may further comprise a number of radially-extending spokes corresponding to the number of side of structures, like the lower central support structures. Each joint surface of the upper hub may be joined to an end of a spoke with a connector being provided to allow the spoke to be joined to the associated joint surface when the tree is being assembled and separated from the associated joint surface when the tree is being disassembled. Each spoke supports, at its other end, an uppermost elongate piece of a side structure with a connector being provided to allow the uppermost elongate piece to be joined to the associated spoke when the tree is being assembled and separated from the associated spoke when the tree is being disassembled. The spokes may be short in length and positioned away from the upper ends of the uppermost elongate pieces of the side structures such that the uppermost elongate pieces may still meet at a point at the top of the tree, or end in close proximity to one another.

Advantageously, the hubs of the central support structures are aligned vertically along a central vertical axis of the modular Christmas tree, and the radially-extending spokes of each central support structure have the same length which spans from the central hub to join to the side structures. While the spokes within a central support structure may be the same, the spokes may differ between central support structures. For example, in order to form the tapering shape of the modular Christmas tree, the length of the spokes the central support structures may increase from the top to the bottom of the modular Christmas tree (where the tree comprises at least two central support structures comprising radially-extending spokes). The spokes of each central support structure may be the same, i.e. of a common design. Such commonality helps reduce manufacturing time and costs. The spokes of different central support structures may be of a similar design, with just their lengths varied. For example, the ends of each spoke may be the same and may comprise the same configuration to allow connection to a hub and side structure, with just the length of a plain central section being varied. For instance, each spoke may have one vertical end face to mate with a joint surface of a hub, and may have an oblique end surface to mate with an angled side of an elongate piece of a side structure.

Many different types of connectors for the various joints may be used. Advantageously, the same type of connector may be used for all, or the majority of the joints. For example, simple dowelled butt joints may be used for all or some of the joints. The dowelled butt joint may comprise one or more simple dowels. Each dowel is received in holes provided in the two components to be joined. The size of the holes may correspond to that of the dowel, such that a snug fit is achieved. The snug fit should allow relatively easy joining and separating of the two components, yet provide the required structural integrity of the assembled Christmas tree. The holes may have a tapering shape so as to be wider at their opening than at the bottom of the hole. The size at the bottom of the hole may correspond to width size of the dowel. This tapering may be gradual or may be stepped. For example the hole may comprise two steps and hence three sections of narrowing size as the hole deepens. The tapering may be 5% or less of the width on the opening of the hole. This provides greater tolerance when inserting the dowel into the hole and also eases separation of the joint when disassembling the Christmas tree. The dowels may be wooden or metal, and may be circular in cross section (when viewed from the end), although other shapes may be used such as square, rectangular, oval and race-track shaped. The same size dowel may be used for multiple joints or even for all joints, as this reduces manufacturing time and costs.

Hence, where the upper hub is joined directly to the uppermost elongate pieces, each connector provided between the upper hub and an uppermost elongate piece may comprise a dowel seated within a hole provided in the joint surface of the upper hub and an aligned hole provided in the uppermost elongate piece. Also, or in the alternative, each connector provided between a lower hub and a spoke may comprise a dowel seated within a hole provided in the joint surface of the lower hub and an aligned hole provided in the end of the spoke. Each connector provided between a spoke and an elongate piece may comprise a dowel seated within a hole provided in the other end of the spoke and an aligned hole provided in the elongate piece. Each of the joints described in this paragraph may comprise a single dowel received in a single pair of aligned holes or alternatively two dowels received in two pairs of aligned holes, which provides greater rigidity to the joint.

To provide greater structural integrity for the assembled Christmas tree, each connector provided at the overlapping portions of two elongate pieces may comprise a pair of dowels seated within respective pairs of aligned holes provided in the elongate pieces. Each pair of dowels may be separated along the length of the associated overlapping portion.

As an alternative to simple dowelled butt joints comprising a plain dowel received in corresponding holes, more complex dowelled butt joints may be formed. For example, any of the connectors may comprise of a cam nut and cam dowel. In such arrangements, the cam dowel is screwed into one of the components and its head is received in a hole provided in the other component. The hole terminates in a chamber housing the cam nut such that the head of the cam dowel is received within the cam nut. The chamber extends to a side of the components to provide access to the cam nut. Rotating the cam nut causes a cam surface of the cam nut to tighten against the head of the cam dowel, thereby pulling the components together and securing the joint. For example, each connector provided at the overlapping portions of the elongate pieces may comprise (1) a dowel seated within respective pairs of aligned holes provided in the elongate pieces and (2) a cam nut and cam dowel. Then, the cam dowel may be screwed into one of the elongate pieces and its head is received in a hole provided in the other of the elongate pieces. Rotating the cam nut causes the cam surface of the cam nut to tighten against the head of the cam dowel, thereby securing the elongate pieces together.

The angle between adjacent spokes may be the same for all pairs of adjacent spokes, to meet the side structures that are also separated by equal angles. This provides a pleasing symmetry to the modular Christmas tree.

As mentioned above, using a common design for multiple components of the modular Christmas tree is advantageous as it reduces manufacturing time and costs. It also aids in assembly of the modular Christmas tree as less skill is required on the part of the assembler in discriminating between similar yet distinct parts.

To this end, the hubs may share a common design. This may be true even for the upper hub of the upper central support structure that my join directly to the uppermost elongate pieces and also for the lower hub(s) of the lower central support structure(s) that join to spokes. The hubs may have a horizontal cross section in the shape of a regular polygon, with the number of sides of the polygon equaling the number of side structures. Other arrangements are possible. For example, the hubs may have twice as many sides as the number of side structures. This may be advantageous as it allows a common design to be used where a manufacturer offers different designs of modular Christmas tree. Six-sided and three-sided modular Christmas trees may be provided, where each side of hexagonal hubs are used in the six-sided trees and alternate sides of the hexagonal hubs are used for the three-sided trees.

The intermediate elongate pieces may share a common design, and the lowermost elongate pieces may share a common design which may or may not be the same as that of the intermediate elongate pieces. The uppermost elongate pieces may share a common design which may or may not be the same as that of the intermediate elongate pieces.

The modular nature of the Christmas tree lends itself well to the provision of trees of different heights. For instance, the number of intermediate elongate pieces in each side structure may be varied to alter the height of the tree. The elongate pieces occupying the same height in a tree may be considered as a "level" of the tree, and hence the height of a tree may be varied by adjusting the number of levels. Hence, a manufacturer may simply manufacture a common design of elongate pieces, and provide different number of elongate pieces according to the height of tree required. Similarly, an owner may build a modular Christmas tree to different heights, for example making a shorter tree if desired or needed (for example, following a move to a smaller home).

Different number of levels may require different numbers of central support structures. For example, the modular Christmas tree may comprise a number of tiers, each tier comprising two levels of elongate pieces and a central support structure. Hence, for each side structure, the series of joined elongate pieces may alternate between elongate pieces supported by a support structure and elongate pieces not supported by a support structure. This would provide the following designs: (i) a tree with three intermediate elongate pieces, and an upper central support structure and one lower central support structure; (ii) a tree with five intermediate elongate pieces, and an upper central support structure and two lower central support structures; and (iii) a tree with seven intermediate elongate pieces, and an upper central support structure and three lower central support structures.

In addition, a manufacturer may provide different number of elongate pieces, spokes and different hub designs according to the number of sides required. This allows modular Christmas trees having a range of numbered sides and, independently, a range of different levels or tiers (and hence heights) to be supplied. For example, a manufacturer could hold a stock of a common design of uppermost elongate pieces, a common design of intermediate and lowermost elongate pieces, pentagonal, hexagonal and octagonal hubs, and spokes of three different lengths, and dowels, making nine components in total. This allows trees having three, four, five, six and eight sides, and trees having two, three of four tiers. Hence, a stock of nine components allows fifteen different designs of tree. Even more designs are possible if tiers having more than two levels of elongate pieces are used.

This also provides benefits to the owner of a modular Christmas tree. The owner may omit one or more sides, for example to allow the tree to be placed closer to a wall or up against a wall. Also an owner may use fewer side structures if desired, for example such that a six-sided tree may be built as a three-sided tree. Other changes may be made to a tree requiring just some components to be purchased rather than another complete tree. For example, a user wishing to change a five-sided tree into a four-sided tree with evenly space sides may simply purchase new hubs. Conversely, a user wanting a tree with more sides may purchase just the side pieces required for each additional side structure and possibly new hubs.

Optionally, the hubs, spokes and elongate pieces are made from wood, either hard wood or soft wood. This is more environmentally friendly than the plastics used in many artificial Christmas trees. The connectors may also be made from wood, such as wooden dowels. Metal parts may be used, for example for the cam nut and dowels mentioned above, as this avoids the negative environmental issues associated with the use of plastics.

Further optional features will become evident to the person skilled in the art upon reading the following detailed description of the invention.

BRIEF DESCRIPTION OF THE DRAWINGS

In order that the invention can be more readily understood, reference will now be made by way of example only, to the accompanying drawings in which:

FIGS. 17 and 18 are a side view and detail of an alternative connector for joining the side pieces.

DETAILED DESCRIPTION OF THE INVENTION

Figure 1:
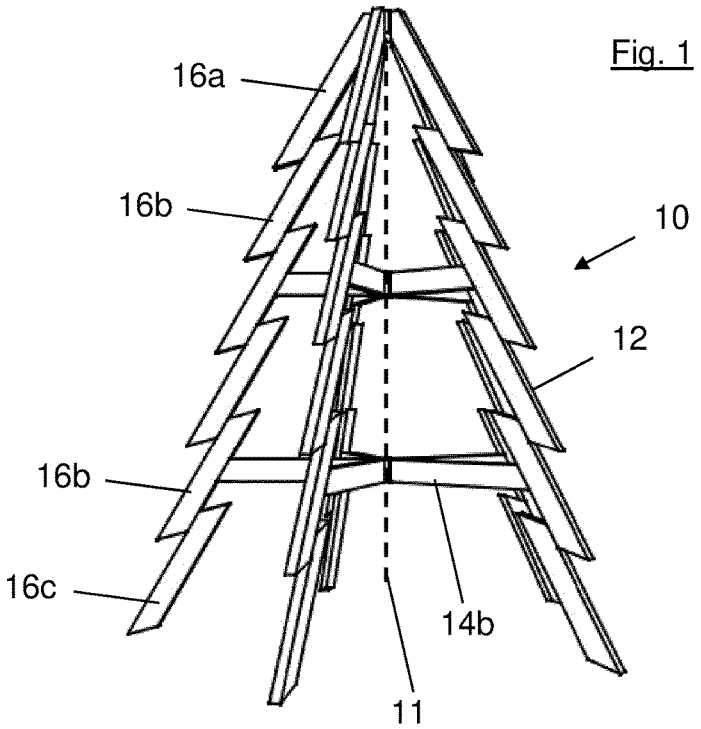
FIGS. 1 and 2 are perspective views of an assembled artificial Christmas tree.
Figure 3:
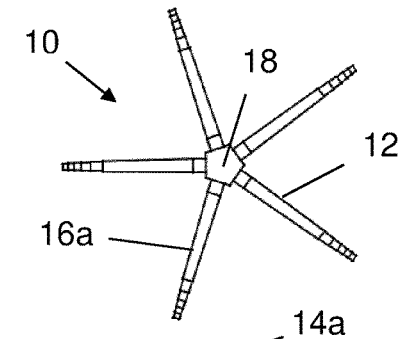
FIG. 3 is a top view of the artificial Christmas tree of FIGS. 1 and 2.
Figure 2:
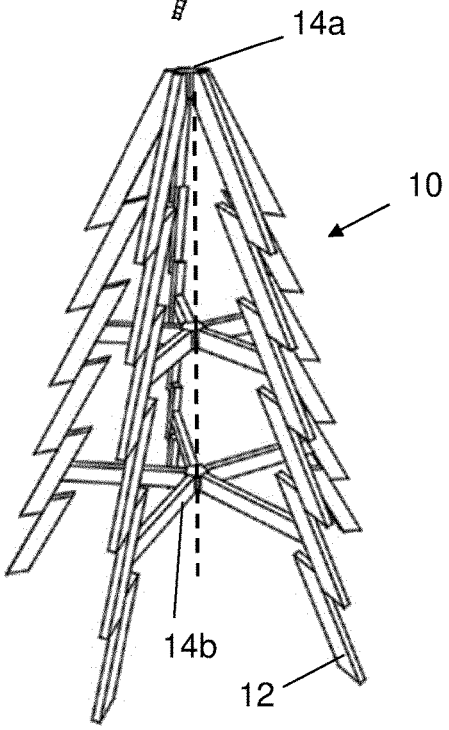

A modular, artificial Christmas tree 10 is shown in FIGS. 1 to 3. The Christmas tree 10 has five sides 12 (also referred to herein as side structures), and each side 12 has a zig-zag shape. The sides 12 are angled such that the Christmas tree 10 has a tapering shape with a wide base and a narrow top. The example Christmas tree 10 of FIGS. 1 to 3 is approximately 1.5 m tall and has a base diameter of approximately 1.2 m.

The modular Christmas tree 10 does not have a central trunk, and is instead supported on the floor by its five sides 12. Three central support structures 14 support the sides 12 at different heights, and provide rigidity to the Christmas tree 10. The tree 10 has a central vertical axis 11 that is indicated in the figures. The central support structures 14 are arranged centrally with respect to this axis 11, and extend outwardly from the axis 11.

The five sides 12 of the Christmas tree 10 meet at the top of the tree 10 and extend downwardly as a series of overlapping side pieces 16. Each side piece 16 is elongate. The side pieces 16 are oblique rather than being vertical, hence contributing to the tapering shape of the Christmas tree 10. The ends of the side pieces 16 overlap at overlapping portions to give each side 12 its zig zag shape. Where two side pieces 16 meet, the higher side piece 16 is positioned inside (i.e. closer to the central axis 11 of the tree 10) than the lower side piece 16. Each side 12 comprises four intermediate side pieces 16*b* that are joined to other side pieces 16 at both ends. Each side 12 also comprises a bottom side piece 16*c* which is joined to an intermediate side piece 16*b* at one end and rests upon the floor at its other end. This other end is angled relative to the length of the bottom side piece 16*c* such that the entire other end rests against the floor. Finally, each side 12 also has a top side piece 16*a* which is joined to an intermediate side piece 16*b* at one end and is supported by an upper central support structure 14*a* its other end.

The upper central support structure 14*a* comprises a hub 18 which is positioned with its centre positioned on the central axis 11 of the tree 10. The hub 18 has a pentagonal cross section whose periphery does not vary with height, such that the hub 18 comprises five identical joint surfaces 20 which are vertical. The upper end of each top side piece 16*a* joins the hub 18 at a joint surface 20.

Two lower central support structures 14*b* are also provided. Each of the lower central support structure 14 comprise a hub 18 that is of the same design as the hub 20 of the upper central support structure 14. Each hub 18 is positioned with its centre positioned on the central axis 11 of the tree 10. In the lower central support structure 14*b*, the hub 18 is joined to the sides 12 by five spokes 22. For each spoke 22, one of its ends is joined to a joint surface 20 of the hub 18 and its other end is joined to an intermediate side piece 16*b*. The spokes 22 extend horizontally from the hub 18 which is positioned centrally within the tree 10. Each spoke 22 in a lower central support structure 14*b* has the same length as the other spokes 22 in the lower central support structure 14*b*. However, the tapering shape of the Christmas tree 10 requires the length of the spokes 22 to vary between the lower central support structures 14*b*, with the length increasing from top to bottom of the tree 10.

Figure 4:
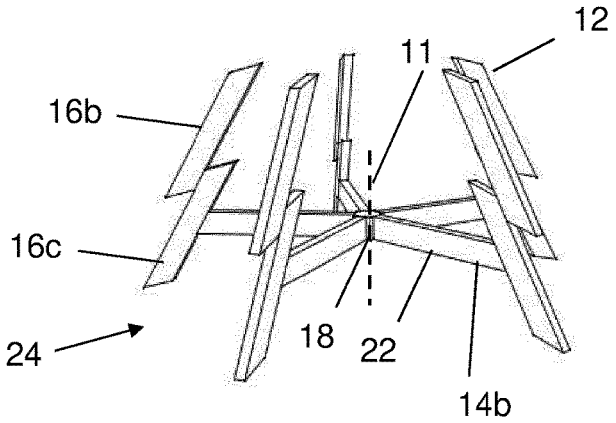
FIG. 4 is a perspective view of part of the artificial Christmas tree of FIGS. 1 to 3, showing two levels of the tree.

The central support structures 14 are provided for every other level of side pieces 14 such that alternate side pieces 14 of each side 12 are supported by a central support structure 14. The top side piece 16*a* of each side 12 is supported by the upper central support structure 14*a*, and the second and fourth intermediate side pieces 16*b* of each side 12 are supported by the lower central support structures 14*b*. Hence, the modular Christmas tree 10 comprises three tiers 24, each tier 24 comprising a central support structure 14 and ten side pieces 16. A first level of five of the side pieces 16 being supported directly by the central support structure 14 and a further level of five side pieces 16 arranged above and joined directly to the side pieces 16 of the first level, and so the five side pieces 16 of the further level are indirectly supported by the central support structure 14. FIG. 4 shows one of the tiers 24 including a lower central support structure 14*b*. As will be appreciated, a modular Christmas tree 10 of greater or lesser height may be made by simply adding or removing tiers 24. Some examples are shown in FIGS. 12 to 16, and these will be described in further detail below.

The hubs, 18, spokes 22 and side pieces 16 are held in place using connectors which, in this example, are provided by dowels 26 that are received within co-operating holes of a constant (or substantially constant) width to form dowelled butt joints. All dowels 26 are of a common design such that they have the same size and shape. In this example, the dowels 26 are round in cross-section, although other shapes such as oval, race-track, square or rectangular cross sections may be used. How the hubs, 18, spokes 22 and side pieces 16 connect together such that they may be separated as required for disassembly and storage of the tree 10 will now be explained with reference to FIGS. 5 to 10.

Figure 5:
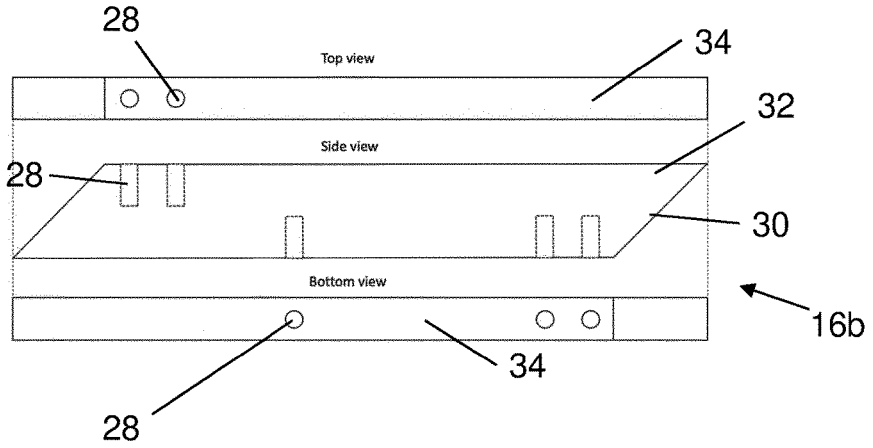
FIG. 5 are top, side and bottom views of an intermediate elongate piece of the artificial Christmas tree of FIGS. 1 to 3.

The intermediate side pieces 16*b* and the bottom side pieces 16*c* all share a common design that corresponds to that shown in FIG. 5. Each intermediate and bottom side piece 16*b* and 16*c* is elongate, and is also taller than it is deep. In this example, the intermediate and bottom side pieces 16*b* and 16*c* have dimensions of 325 mm×44 mm×19 mm. Hence, each of the intermediate and bottom side pieces 16*b* and 16*c* comprise two ends 30, two wide edges 32 and two narrow edges 34.

The ends 30 are cut obliquely at the same angle (to provide internal angles of 45° and 135° in this example) so that the intermediate and bottom side pieces 16*b* and 16*c* form parallelograms when viewed from the side (parallelogram according to UK English). Each of the intermediate and bottom side pieces 16*b* and 16*c* is provided with five blind holes 28 that are the same width as each dowel 26 and half the length of each dowel 26. A pair of blind holes 28 is provided in each narrow edge 34 where the narrow edges 34 meet the ends 30 at an obtuse angle, as can be seen in FIG. 5. The holes 28 in each pair are aligned along the length of the side piece 16. The fifth blind hole 28 of each of the intermediate and bottom side pieces 16*b* and 16*c* is provided centrally midway along one of the narrow edges 34.

Figure 6:
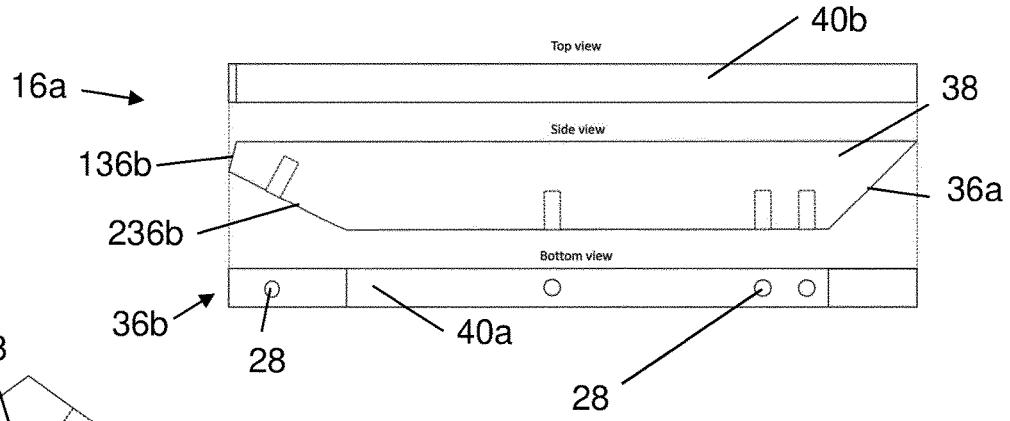
FIG. 6 are top, side and bottom views of an uppermost elongate piece of the artificial Christmas tree of FIGS. 1 to 3.
Figure 7:
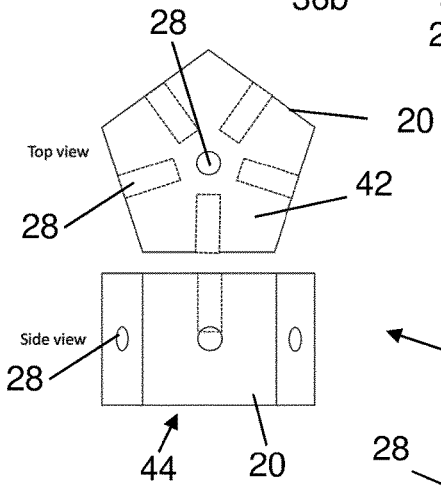
FIG. 7 are top and side views of a hub of the artificial Christmas tree of FIGS. 1 to 3.

FIG. 6 shows that the top side pieces 16*a* all share a common design that differs slightly from the intermediate and bottom side pieces 16*b* and 16*c*. One end 36*a* of each top side piece 16*a* is the same as the ends 30 of the intermediate and bottom side pieces 16*b* and 16*c*. This end 36*a* joins to an intermediate side piece 16*b*. The other end 36*b* joins to the top hub 18 and comprises two sides, namely a short side 136*b* and a long side 236*b* which meet at a right angle. The long side 236*b* abuts against a vertical joint surface 20 of the top hub 18 such that the right angle aligns with the top of the top hub 18 when the modular Christmas tree 10 is assembled. Hence, the long side 236*b* is vertical when the Christmas tree 10 is assembled and the short side 136*b* extends a short distance horizontally from the top of the top hub 18. The orientation of the long side 236*b* relative to the edges 32 and 34 determine the angle to the vertical made by the sides 12 of the modular Christmas tree 10, as will be described in more detail below.

As best seen in FIG. 6, each top side piece 16*a* has an approximate trapezium shape when viewed from the side (if the short side 136*b* is ignored, and taking the UK English meaning of trapezium). Thus, unlike the intermediate and bottom side pieces 16*b* and 16*c*, the top side pieces 16*a* have one narrow edge 40*a* that is shorter than the other narrow edge 40*b*. The shorter narrow edge 40*a* is provided with the central hole 28 and the pair of holes 28 adjacent end 36*a*, as for the intermediate and bottom side pieces 16*b* and 16*c*. The long side 236*b* of end 36*b* is provided with a fourth blind hole 28, which also the same width as each dowel 26 and half the length of each dowel 26. In this example, the top side pieces 16*a* have dimensions of 370 mm×44 mm×19 mm.

To assemble each side 12, a top side piece 16*a* is joined to an intermediate side piece 16*b* by placing a dowel 26 into each blind hole 28 of a pair of blind holes 28 of either the top side piece 16*a* or the intermediate side piece 16*b*. Then, the remaining exposed portions of the dowels 26 are inserted into each blind hole 28 of a pair of bind holes 28 of the other of the top side piece 16*a* or the intermediate side piece 16*b*, thereby joining the top side piece 16*a* and the intermediate side piece 16*b*. The intermediate side piece 16*b* is aligned such that the blind hole 28 provided in its narrow edge 34 is on the same side as the blind hole 28 provided in the long side 236*b* of the top side piece 16*a*. In this embodiment, blind holes 28 have a constant (or substantially constant) width and are sized to match the dowels 26 to provide a snug fit, such that the top side piece 16*a* and the intermediate side piece 16*b* require reasonable force to be applied to pull them apart. Providing a pair of dowels 28 to each joint between the top side piece 16*a* and the intermediate side piece 16*b* provides the desired alignment between the side pieces 16*a* and 16*b*, and provides the required strength for the sides 12 to be self-supporting. Both ends 30 of the intermediate side piece 16*b* will be aligned with the end 36*a* of the top piece 16*a*.

Figure 9:
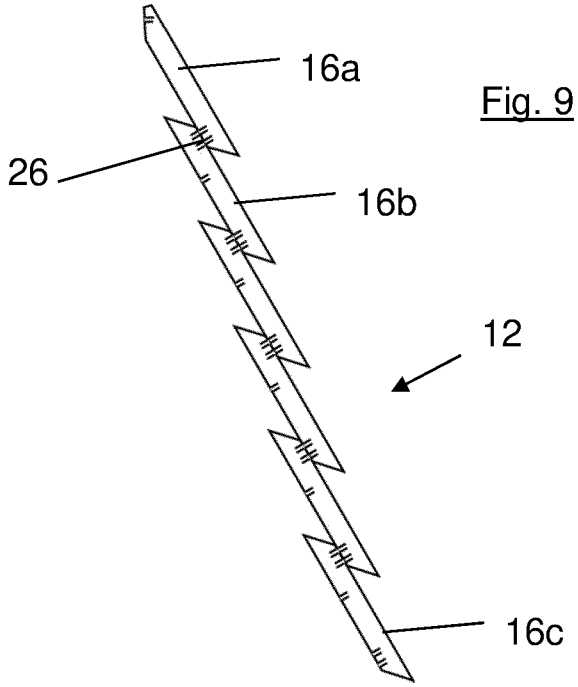
FIG. 9 is a side view of an assembled side of the artificial Christmas tree of FIGS. 1 to 3.

Next, a further intermediate side piece 16*b* is joined to the existing intermediate side piece 16*b*. A further pair of dowels 26 are used to join the unused pair of blind holes 28 from the existing intermediate side piece 16*b* with a pair of blind holes 28 of the further intermediate side piece 16*b*. The intermediate side pieces 16*b* are aligned such that the blind holes 28 provided in their narrow edges 34 are all on the same side. This step is repeated to make up the required number of side pieces 16 for each side 12. For the Christmas tree 10 of FIGS. 1 to 3, this step is repeated four times to produce sides 12 having a top side piece 16*a*, four intermediate side pieces 16*b* and a bottom side piece 16*c* (remembering that the design of the intermediate side pieces 16*b* and bottom side piece 16*c* is the same). When complete, a side 10 like that shown in FIG. 9 is produced. All ends 30 of the intermediate side pieces 16*b* will be aligned at the same angle. The ends 30 may be horizontal or may be aligned at a different angle, for example to create an overhang. As noted above, the angle adopted by the ends 30 is determined by the orientation of the long side 236*b* of the end 36*b* relative to the edges 32 and 34 of the top sidepiece 16*a*.

It does not matter in which order the side pieces 16 are assembled. Although the preceding description starts with the top side piece 16*a* and an intermediate side piece 16*b*, assembly of a side 12 may start with two intermediate side pieces 16*b* or an intermediate side piece 16*b* and a bottom side piece 16*c*.

The central support structures 14 will now be described in more detail. All hubs 18 in the Christmas tree 10 of FIGS. 1 to 3 share the common design of hub 18 shown in FIG. 7. Each hub 18 has a pentagonal top surface 42 and a pentagonal bottom surface 44, and five joint surfaces 20 arranged around its sides. In this example, the hubs 18 have dimensions of 60 mm×63 mm×44 mm. A blind hole 28 is provided centrally in each joint surface 20. A further blind hole 28 is provided centrally in the top surface 42. Each blind hole 28 has the same width as each dowel 26 and half the length of each dowel 26.

For the upper central support structure 14*a*, each top side piece 16*a* is joined directly to the top hub 18 using dowels 26. Namely, to continue assembly of the Christmas tree 10, a dowel 26 is placed into each hole 28 provided in the five joint surfaces 20. Then, the top side piece 16*a* of each side 12 is joined to the hub 18 by inserting an exposed end of a dowel 26 into the blind hole 28 provided in the long side 236*b* of the end 36*b* of the top side piece 16*a*. With all five sides 12 joined to the top hub 18 in this way, the Christmas tree 10 is loosely held together although the lower central support structures 14*b* are required to strengthen the tree 10 and hold the sides 12 in true alignment and at the desired angle to the vertical.

Figure 8:
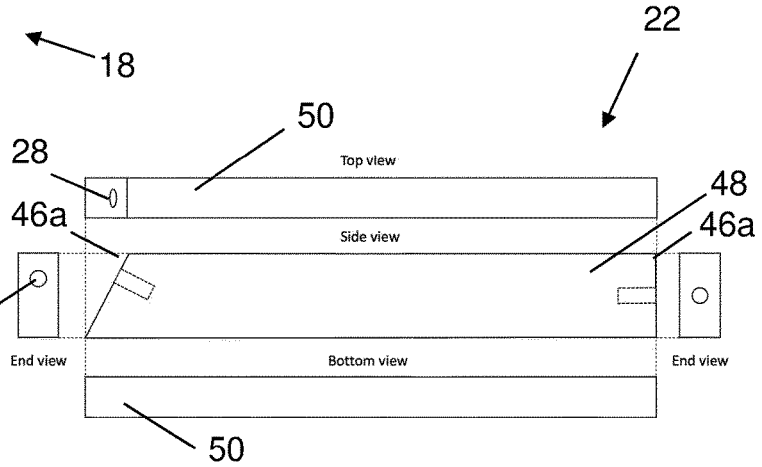
FIG. 8 are top, side and bottom views of a spoke of the artificial Christmas tree of FIGS. 1 to 3.

The spokes 22 from each lower central support structure 14*b* share a common design that corresponds to that shown in FIG. 8. Each spoke 22 is elongate along its length, and is also taller than it is wide. Hence, each spoke 22 comprises two ends 46, two wide edges 48 and two narrow edges 50. One end 46*a* is cut square and the other end 46*b* is cut obliquely to match the angle that the sides 12 make to the vertical. Each of the spokes 22 is provided with two blind holes 28 that are the same width as each dowel 26 and half the length of each dowel 26. One blind hole 28 is provided in each end 46 of a spoke 22. As noted above, the spokes 22 of different lower central support structures 14*b* have different lengths. In this example, the upper spokes 22 have dimensions of 195 mm×44 mm×19 mm and the lower spokes 22 have dimensions of 310 mm×44 mm×19 mm. The ends of the spokes 22 remain the same, and the length of the plain, middle portion of each spoke 22 is increased or decreased. This ensures that the square end 46*a* remains square and the oblique end 46*b* terminates with the same angle for all spokes 22.

Figure 10:
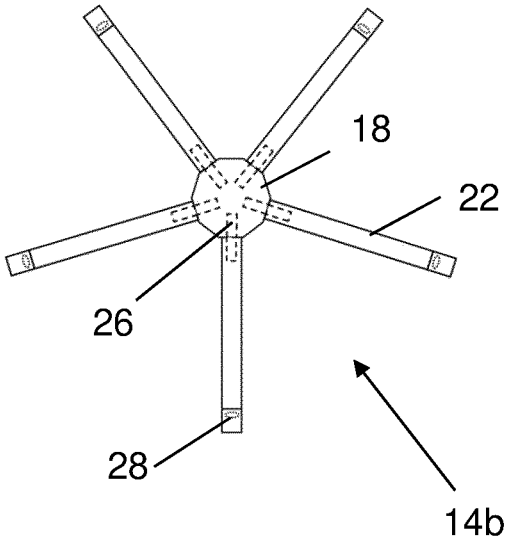
FIG. 10 is a top view of an assembled central support structure of the artificial Christmas tree of FIGS. 1 to 3.

The spokes 22 may be joined to the hubs 18 of the lower central support structures 14*b* as follows. A dowel 26 is placed into each hole 28 provided in the five joint surfaces 20 of the hub 18. Then, each spoke 22 is joined to the hub 18 by inserting an exposed end of a dowel 26 into the blind hole 28 provided in the square end 46*a* of the spoke 22. FIG. 10 shows a lower central support structure 14*b* formed in this way with all five spokes 22 joined to the hub 18.

Assembly of the modular Christmas tree 10 is continued by joining the lower central support structures 14*b* to the sides 12 of the tree 10. Dowels 26 are placed in the blind holes 28 provided in the oblique end 46*b* of each spoke 22. Each lower central support structure 14*b* is then offered up to the sides 12 of the tree 10 at the correct height (i.e. the correct level of side pieces 16 such that the spokes 22 extend to meet those side pieces 16). The blind hole 28 provided in the narrow edge 34 of each intermediate side piece 16*b* is pushed onto the exposed portion of one of the dowels 26. When all five spokes 22 of each of the pair of lower central support structures 14*b* are joined in this way, the modular Christmas tree 10 of FIGS. 1 to 3 is formed. All components are joined by dowelled butt joints and the components are shaped such that the surfaces of the joined components abut against each other when the components are pushed fully together. With the Christmas tree 10 fully assembled in this way, the sides 12 and central support structures 14 provide rigidity to the tree 10, and also ensure the correct alignment of the sides 12.

When assembled, the ends 36*b* of the top side pieces 16*a* will be aligned vertically where they meet the top hub 18, as described above. In this example, the long sides 236*b* of the top side pieces 16 are angled relative to the edges 32 and 34 such that the ends 36*a* and 30 of the intermediate and bottom side pieces 16*b* and 16*c* are angled slightly away from the horizontal (by 15°) thereby creating an overhang to each end 36*a* and 30. This also means that bottom end 30 of the bottom side pieces 16*c* does not rest flat against a level floor. Instead, just the edge of the bottom end 30 contacts the floor. The reduced contact area has been found to provide more grip with the floor. Alternatively, the long sides 236*b* of the top side pieces 16 may be angled relative to the edges 32 and 34 such that the ends 36*a* and 30 of the intermediate and bottom side pieces 16*b* and 16*c* adopt angles other than 15° from the horizontal, or may be aligned with the horizontal. In the latter case, the bottom end 30 of the bottom side pieces 16*c* will rest flat against a level floor. Also, the angle the ends 36*a* and 30 of the intermediate and bottom side pieces 16*b* and 16*c* adopt may also be varied by altering the angle at which the ends 36 and 30 are cut from the 45° described above.

The hole 28 provided in the top surface 42 of the top hub 18 allows further decorative items like a star or fairy to be mounted on top of the tree 10. The decorative item may be mounted to the tree 10 directly by being placed into the hole 28, or indirectly by having a further mounting structure such as a mast placed into the hole 28. An attachment may also be fixed to the hole 28 provided in the top surface 42 of the top hub 18 to allow the modular Christmas tree 10 to be suspended from a structure such as a ceiling. The attachment may be a hook.

Further decoration may be added to the modular Christmas tree 10. Tinsel, ribbons or lights may be strung around the tree 10, for example using the ends 30 of the side pieces 16 that provide a horizontal surface for supporting such items when the tree 10 is assembled. Alternatively, the side pieces 16 may be provided with features to allow decorations to be hung, for example holes, hooks or notches. As the modular Christmas tree 10 does not include a supporting trunk, a large, uninterrupted storage area results at the base of the tree 10. This may be used to store Christmas presents. Hence, the modular Christmas tree 10 addresses some of the disadvantages of real and traditional artificial Christmas trees, whilst providing the same focal point of a Christmas tree during the festive season.

The modular Christmas tree 10 may be made from many different materials. Wood is preferred, although not essential. For example, the tree 10 of FIGS. 1 to 3 is made entirely of wood. Any hardwood may be used and will create an attractive appearance. However, less expensive modular Christmas trees 10 may be made from softwood or processed wood such as chipboard or fibre boards like mdf. The dowels 26, which are hidden from view when assembled, are well suited to the use of softwood. While wood is a preferred material as it provides a more environmentally friendly Christmas tree 10, this does not preclude the use of metals or even plastics for all or some of components of the tree 10. In order to offset some environmental disadvantages of using plastic and metal parts, the parts could be made using additive manufacturing processes which would reduce waste when compared with reductive manufacturing processes like that required when making wooden components.

Each side piece 16 is aligned at 30° to the vertical. However, the overlap of adjacent side pieces 16 means that the overall angle of each side 12 to the vertical is less. The example Christmas tree 10 of FIG. 1 is approximately 1.5 m tall and has a base diameter of approximately 1.2 m, giving an overall angle of approximately 21° for each side 12. For the side pieces 16 of the Christmas tree 10 of FIGS. 1 to 3, a range of or 25° to 35° (which may be approximate) to the vertical and an overlap of between 30 mm and 100 mm has been found to provide a pleasing overall appearance to the modular Christmas tree 10 with the length of intermediate side piece 16*b* described, however, the overlap could vary more greatly with the use of longer intermediate side pieces 16*b*. These values may be varied to create different appearances to a tree 10 to suit individual tastes.

Figure 11:
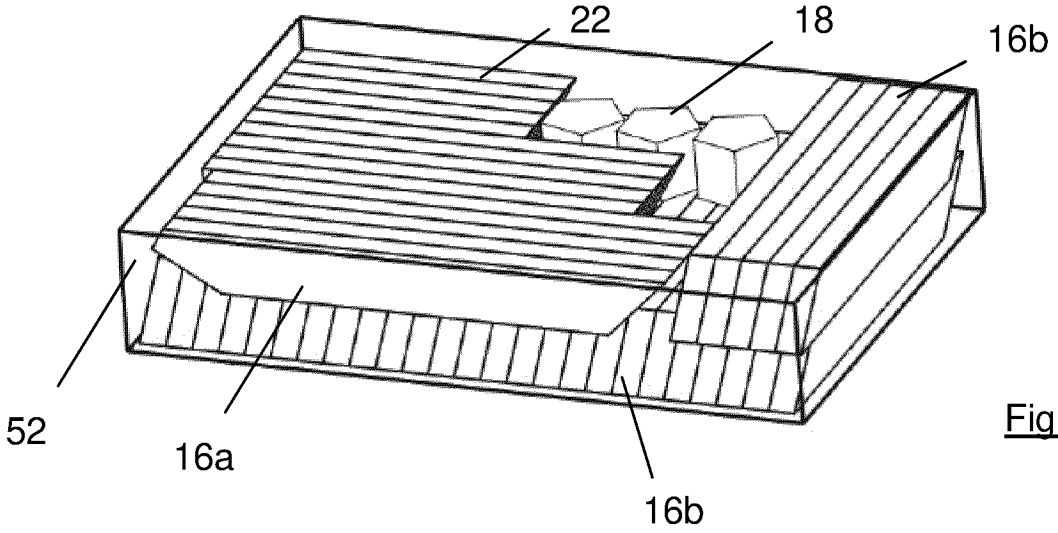
FIG. 11 is a perspective view of the artificial Christmas tree of FIGS. 1 to 3 when disassembled and packed into a storage box.

The modular Christmas tree 10 may be easily dissembled at the end of the festive season so as to allow compact storage. The side pieces 16, spokes 22 and hubs 18 may be pulled apart. The dowels 26 may be removed from the blind holes 28, or may be left in place as they occupy little additional space. The disassembled side pieces 16, spokes 22, hubs 18 and dowels 26 may then be packed into a box 52 for storage. FIG. 11 shows the 1.5 m by 1.2 m Christmas tree 10 of FIGS. 1 to 3 packed into a box 52 which has external dimensions of 0.5 m×0.35 m×0.1 m, giving a volume of only 0.0175 $m^3$. As will be appreciated, this is much more compact than traditional artificial Christmas trees. The storage requirements of an equivalently-sized artificial tree are typically 1.25 m×0.5 m×0.35 m, giving a much larger volume of 0.22 $m^3$. This difference is best illustrated by considering that twelve of the modular Christmas trees 10 of FIGS. 1 to 3 could be stored in a single box intended for a traditional tree.

For any particular modular Christmas tree 10, the size of the box 52 can be very small as it merely has to include one dimension that is at least the same length as the longest component of the tree 10.

A person skilled in the art will appreciate that the above embodiments may be varied in many different respects without departing from the scope of the present invention that is defined by the appended claims.

The number of sides 12 of the modular Christmas tree 10 may be varied from the five shown in FIGS. 1 to 3. Also, the number of side pieces 16 in each side 12 may be varied from the six shown in FIGS. 1 to 3. Increasing and decreasing the number of side pieces 16 in each side 12 may alter the height and width of the tree 10, so a different number of central support structures 14 may be used when compared with the three central support structures 14 shown in FIGS. 1 to 3. Also, the length of the side pieces 16 may be varied (and the length of side pieces 16 in a single tree 10 may be varied, for example to have shorter side pieces 16 towards the top of the tree 10), as too may the angle the side pieces 16 make to the vertical when the tree 10 is assembled. Various examples are shown in FIGS. 12 to 16.

Figure 12:
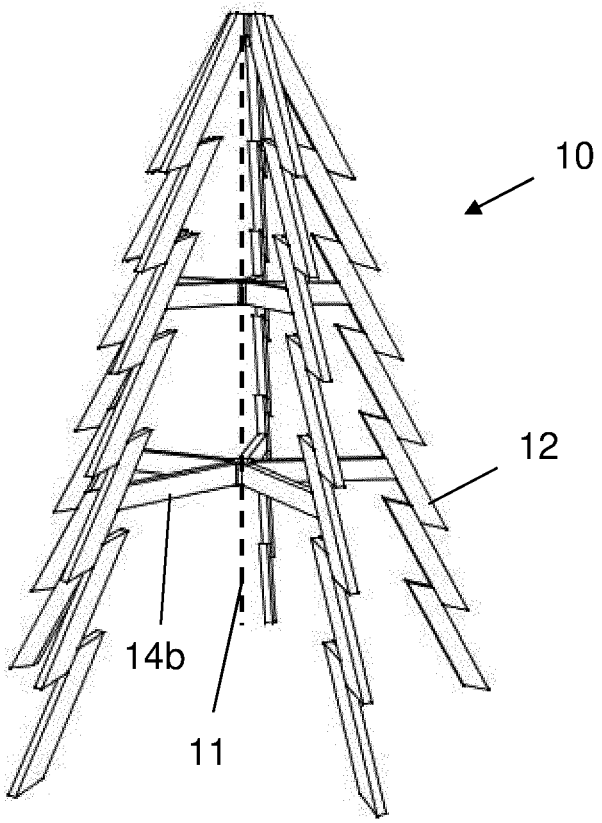
FIGS. 12 to 16 are perspective views of an assembled artificial Christmas trees of different designs having varying numbers of sides, levels and central support structures.

FIG. 12 shows a modular Christmas tree 10 having an additional side piece 16 added to each side 12 of the lowest tier 24 relative to the tree 10 of FIGS. 1 to 3. Hence, each side 12 comprises seven side pieces 16, and the tree 10 still comprises three central support structures 14.

Figure 13:
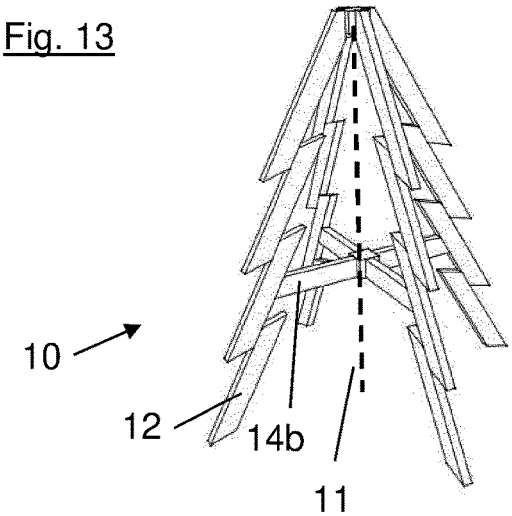

FIG. 13 shows a shorter modular Christmas tree 10 having only four sides 12, with four side pieces 15 per side 12. The tree 10 also requires only two central support structures 14. The hubs 18 are now square in cross section when viewed from above, thereby providing four joint surfaces 20 around the sides of each hub 18.

Figure 14:
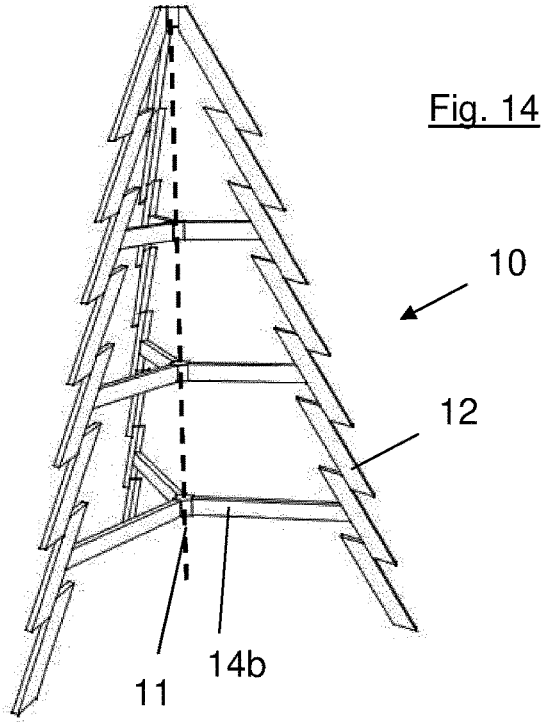

FIG. 14 shows a taller modular Christmas tree 10 having only three sides 12, but eight side pieces 16 per side 12. The increased height of the tree 10 is supported by four central support structures 14. With three sides 12, the hubs 18 could be triangular in cross section when viewed from above. However, in this tree 10 of FIG. 14, hubs 18 with a hexagonal cross section are used, with alternate sides being used as joint surfaces 20 joined to either the top side pieces 16*a* or spokes 22. Blind holes 28 may be provided in just the alternate sides. Alternatively, blind holes 28 may be provided in each of the six sides. This is advantageous as it allows a stock of a common hexagonal hubs 18 to be used for both three-sided and six-sided modular Christmas trees 10.

Figure 15:
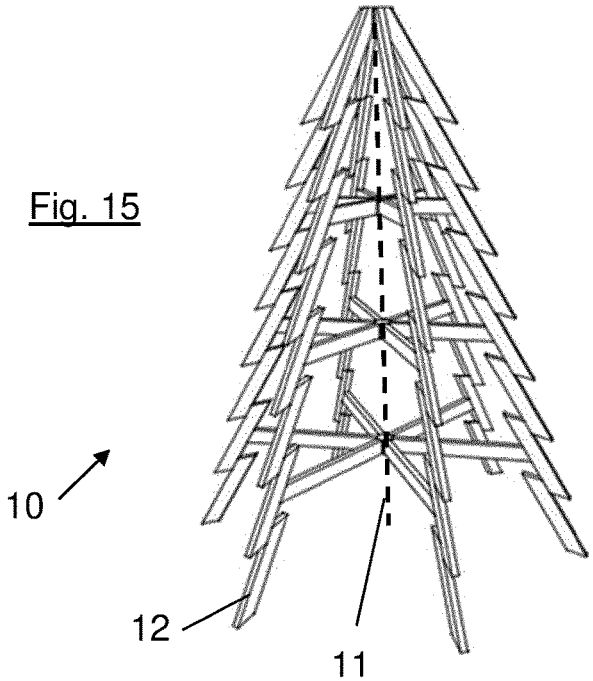

FIG. 15 shows another taller modular Christmas tree 10 having six sides 12 and eight side pieces 16 per side 12. The tree 10 is supported by four central support structures 14, each having a hexagonal hub 18.

Figure 16:
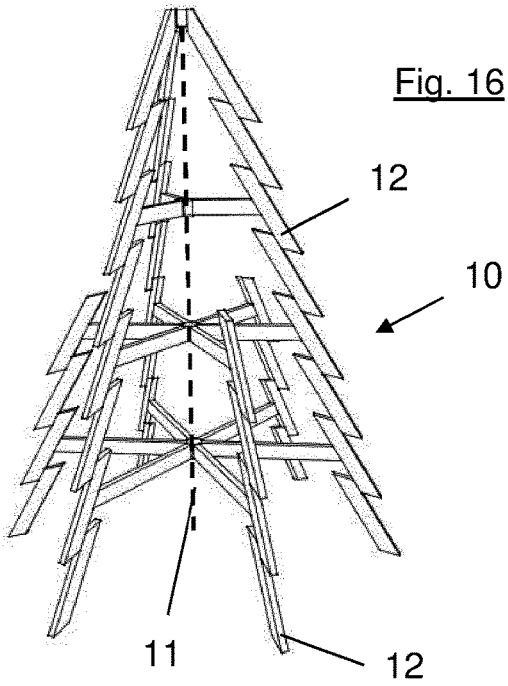

A further variation is shown in FIG. 16. Not all levels of this modular Christmas tree 10 have the same number of side pieces 16. The bottom four levels comprise six sides 12 and are supported by two central support structures 14 with hexagonal hubs 18. Alternate sides 12 continue beyond the fourth level, such that there are four upper levels comprising three sides 12. The upper levels are supported by two central support structures 14 having hexagonal hubs 18 with only alternate sides 12 providing joint surfaces 20.

The modular Christmas trees 10 are primarily designed for domestic use such as in the home or office. Accordingly, typical heights of the tree 10 could be from 0.5 m to 3 m. However, taller trees are of course possible, for example trees 10 could be 5 m or more tall and may be used for outdoors display.

The modular nature of the artificial Christmas tree 10 allows further flexibility in how the tree 10 is used. For example, a modular Christmas tree 10 may be used in corners or against a flat wall. When used against a flat wall, one or more sides 12 and their supporting spokes 22 may be omitted. Where the tree 10 has an even number of sides 12, the tree 10 may then be stood flush against the flat wall. For instance, the six-sided tree 10 of FIG. 15 may have two adjacent sides 12 omitted as well as the spokes 22 supporting these omitted sides 12. The tree 10 may then be placed such that the remaining sides 12 separated by 180° rest against the flat wall. For a 270° corner, one or more sides 12 may be omitted from the tree 10 if necessary. For example, the four-side tree 10 of FIG. 13 may simply be placed against the corner. Five to eight-sided trees 10 may have a single side 12 omitted.

Although straight side pieces 16 are described above, other shapes may be used. The shape may be varied without departing from the desired Christmas tree shape. For example, the side pieces 16 may curve to be steeper at their tops and shallower at their bottoms when assembled. Other shapes and detailing may be provided to the side pieces 16. Also, the spokes 22 need not be straight. The number of central support structures 14 may also be varied, and can be separated by more or less than the alternate levels shown in FIGS. 1 to 3, including a central support structure 14 for each level. Each central support structure 14 need not support every side 12. For instance, one central support structure 14 may support half the sides 12, and the adjacent central support structures 14 may support the other half of the sides 12.

The trees 10 shown in the figures all include an upper central support structure 14*a* that does not have spokes 22. This need not be the case. For instance, all central support structures 14 may have spokes 22. The uppermost central support structure 14 may be provided at the second level of the side pieces 16. In such an arrangement, a common design for all the side pieces 16 may be used as there is no longer a need for a different design to the top side pieces 16*a*.

The spokes 22 shown in the figures are all unitary structures that provide a single part to span from the hub 18 to a side 12. However, multipart spokes 22 may be used instead. For example, the unitary spokes 22 of the figures may be split into two or more parts that may be joined at their ends, for example using dowelled butt joints like those described above.

Cylindrical dowels 26 need not be used. Dowels 26 having cross-sectional shapes other than circles may be used, such as oval, race-track, square, rectangular, etc. Obviously, the blind holes 28 should have a corresponding cross-sectional shape. For non-circular cross-sectional shapes, only a single dowel 26 may be required to join the side pieces 16 to each other. For example, elongate race-track shapes may provide the strength and lack of rotational movement between two side pieces 16.

A modification may be made to the shape of the blind holes 28. In the embodiments described above, the blind holes 28 have a width that is constant and that corresponds to the width of the dowels 26. FIGS. 17 and 18 show a variation of this design where the blind holes 28 have a tapering shape so as to be wider at their opening than at their bottom. The size at the bottom of each blind hole 28 may correspond to the width of the dowel 26. As seen more clearly in FIG. 18, each blind hole 28 comprises two steps and hence three sections 28*a,b,c* of narrowing size as each blind hole 28 deepens. The bottom section 28*c* has the same width as the dowel 26. For example, if a 3 mm diameter dowel 26 is used, the diameter of section 28*c* may be 3.00 mm, the diameter of section 28*b* may be 3.05 mm and the diameter of section 28*a* may be 3.10 mm. Alternatively, the tapering may be gradual such that the blind hole 28 is frustoconical in shape. A tapering blind hole 28 provides greater tolerance when inserting the dowel 26 into the blind hole 28 and also eases separation of the joint when disassembling the Christmas tree 10.

Also, joints other than dowelled butt joints may be used. Joints such as biscuit, mortise and tenon, dovetail and half lap joints may be used. These may all be made using all wooden parts. An alternative form of dowelled butt joint is shown in FIGS. 17 and 18. This joint makes use of conventional cam dowel and cam lock combinations frequently used with flat-pack furniture.

Figure 19:
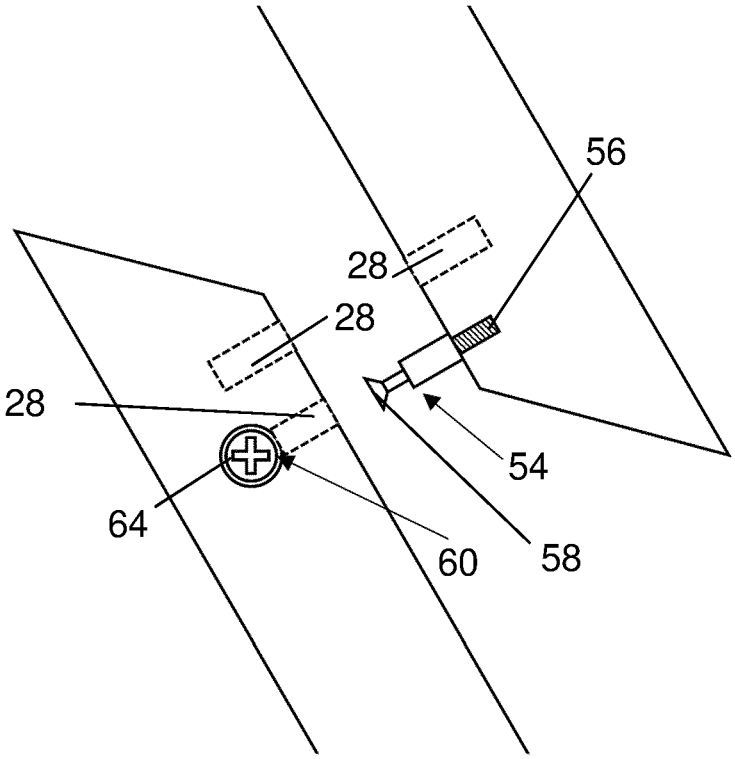
FIGS. 19 and 20 are side views of an alternative connector for joining the side pieces.
Figure 20:
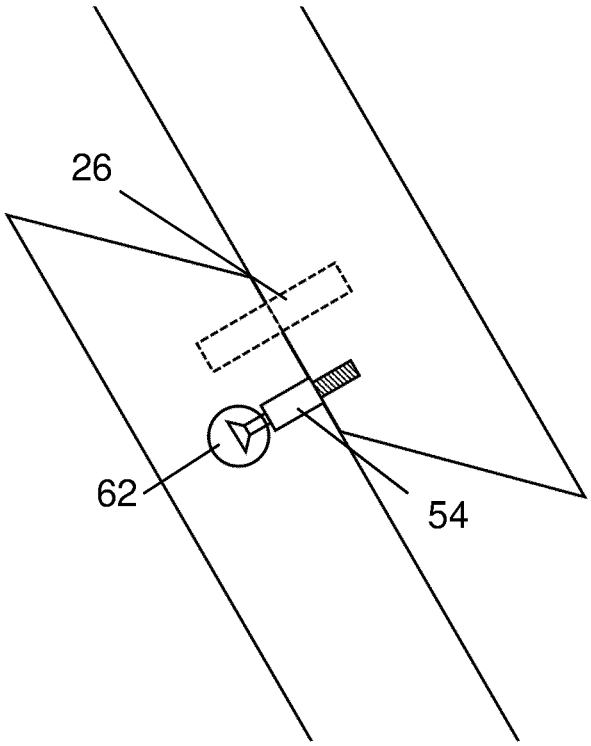

FIGS. 19 and 20 show two side pieces 16 joined in this alternative way. A pair of blind holes 28 of constant width is joined using a plain dowel 26. However, the other of the pairs of blind holes 28 is modified. One blind hole 28 is merely made smaller and is used to accommodate the cam dowel 56. The cam dowel 54 is provided with a thread 56 at one end and a screw head 58 at the other end. The cam dowel 56 is screwed into one side piece 16 using a screwdriver engaged with the screw head 58. The other blind hole 28 of the pair is supplemented by a larger width blind hole 62 formed from the wide edge 32. The hole 62 is sized to correspond to the cam lock 60 such that the cam lock 60 is accommodated in the hole 62. As can be seen from FIG. 19, one side of the cam lock 60 is provided with a crosshead 64 to receive a screwdriver (a slot could be used instead of a crosshead 64 to receive a flat-bladed screwdriver). As is well known, the cam lock 60 also has an aperture provided in its side that is partly defined by a sloping cam surface. The cam lock 60 is placed in the hole 62 with the aperture facing the other blind hole 28. The aperture is sized to receive the screw head 58 of the cam dowel 56 when the sidepieces 16 are placed together as shown in FIG. 20 (the cam lock 60 is omitted from FIG. 18 such that the position of the screw head 58 can be seen more clearly). A screwdriver is then used to rotate the cam lock 60, such that the cam surface is urged against the screw head 58, drawing the two sidepieces 16 into firm engagement with each other. Such a joint provides greater rigidity to the modular Christmas tree 10, albeit with a modest increase in the amount of time required for assembly and disassembly.

Cam dowel and cam lock combinations may be used in the other joints if desired. For example, two such combinations may be used to join side pieces 16, or combinations may be used to join an intermediate side piece 16*b* to spoke 22, or to join a top side piece 16*a* to a hub 18 (in which case, the cam dowel 26 may be conveniently screwed into the hub 18 with the top side piece 16*a* being provided with the cam lock 60 and it accommodating hole 62.

While examples of the order of assembly were provided above, many other orders are possible. For example, the central support structures 14 may be assembled prior to the sides 12. Alternatively, the tree 10 may be assembled level by level. For example, an intermediate side piece 16*b* may be joined to a bottom side piece 16*c* for each of the sides, then a spoke 22 may be joined to each side 12, and the spokes 22 then joined to a hub 18. Next, two levels of side pieces 16 may be joined to each side 12, and another central support structure 14 added, and so on. The order of disassembling the parts of the tree 10 may also be varied. It does not matter into which part a dowel 26 is first placed. For instance, a dowel may be placed into a hub 18 or into a spoke 22 when a hub 18 and spoke 22 are to be joined.

The invention claimed is:

1. A modular Christmas tree comprising:

three or more side structures configured to rise obliquely from a supporting surface, wherein the three or more side structures are arranged obliquely relative to the supporting surface to give the modular Christmas tree a tapering shape that widens from top to bottom; and a plurality of central support structures arranged along and extending outwardly from a central longitudinal axis of the modular Christmas tree, and supporting the three or more side structures, the plurality of central support structures increasing in width from the top to the bottom of the modular Christmas tree to follow the tapering shape of the modular Christmas tree;

wherein:

each side structure comprises a series of joined elongate pieces joined together with connectors that allow the series of elongate pieces to be separated for storage of the Christmas tree in a disassembled state, wherein the series of elongate pieces include an uppermost elongate piece, intermediate elongate pieces and a lowermost elongate piece, the elongate pieces being joined to each other by the connectors such that their ends overlap at overlapping portions to form a zigzag shape, with the connectors being provided at the overlapping portions;

the plurality of central support structures includes an upper central support structure and one or more lower central support structures;

the upper central support structure comprising an upper hub having joint surfaces disposed around its sides with a joint surface for each of the three or more side structures, wherein each joint surface is joined to the uppermost elongate piece of its associated side structure; and each of the one or more lower central support structures comprising a lower hub having joint surfaces disposed around its sides with a joint surface for each of the three or more side structures, and a number of radially-extending spokes, wherein each joint surface is joined to an end of a spoke with a connector being provided to allow the spoke to be joined to the associated joint surface of the lower hub when the tree is being assembled and separated from the associated joint surface of the lower hub when the tree is being disassembled, and wherein each spoke supports, at its other end, an intermediate elongate piece of a side structure with a connector being provided to allow the intermediate elongate piece to be assembled and disassembled from the associated spoke.

2. The modular Christmas tree of claim 1, wherein each joint surface of the upper hub supports the uppermost elongate piece of its associated side structure with a connector being provided to allow the uppermost elongate piece to be joined to and separated from the associated joint surface of the upper hub.

3. The modular Christmas tree of claim 1, wherein the upper central support structure further comprises a number of radially-extending spokes, wherein each joint surface of the upper hub is joined to an end of a spoke with a connector being provided to allow the spoke to be assembled and disassembled from the associated joint surface of the upper hub, and wherein each spoke at its other end supports an uppermost elongate piece of a side structure with a connector being provided to allow the uppermost elongate piece to be assembled and disassembled from the associated spoke.

4. The modular Christmas tree of claim 1, comprising at least two central support structures comprising a number of radially-extending spokes, wherein the number of radially-extending spokes of each of the at least two central support structures have equal length spanning the hub to the side structures, and the length of the spokes of the increases from the top to the bottom of the modular Christmas tree.

5. The modular Christmas tree of claim 1, wherein:

each connector provided between a lower hub and a spoke is a dowel seated within a hole provided in the joint surface of the lower hub and an aligned hole provided in the end of the spoke; or each connector provided between the upper hub and an uppermost elongate piece is a dowel seated within a hole provided in the joint surface of the upper hub and an aligned hole provided in the uppermost elongate piece; or each connector provided between a spoke and an elongate piece is a dowel seated within a hole provided in the other end of the spoke and an aligned hole provided in the elongate piece; or any combination thereof.

6. The modular Christmas tree of claim 1, wherein each connector provided at the overlapping portions of the elongate pieces comprises a pair of dowels seated within respective pairs of aligned holes provided in the elongate pieces.

7. The modular Christmas tree of claim 6, wherein each pair of dowels are separated along the length of the associated overlapping portion.

8. The modular Christmas tree of claim 7, wherein each connector provided at the overlapping portions of the elongate pieces comprises (i) a dowel seated within respective pairs of aligned holes provided in the elongate pieces and (ii) a cam nut and cam dowel, wherein the cam dowel is screwed into one of the elongate pieces and its head is received in a hole provided in the other of the elongate pieces, wherein the hole terminates in a chamber housing the cam nut such that the head of the cam dowel is received within the cam nut, and wherein rotating the cam nut causes a cam surface of the cam nut to tighten against the head of the cam dowel, thereby securing the elongate pieces together.

9. The modular Christmas tree of claim 1, wherein the angle between adjacent spokes is the same for all pairs of adjacent spokes.

10. The modular Christmas tree of claim 1, wherein the hubs share a common design.

11. The modular Christmas tree of claim 10, wherein the hubs have a horizontal cross section in the shape of a regular polygon and with the number of sides of the polygon either equalling the number of side structures or equalling twice the number of side structures.

12. The modular Christmas tree of claim 1, wherein the intermediate elongate pieces share a common design and/or the lowermost elongate pieces share a common design.

13. The modular Christmas tree of claim 12, wherein a common design is used for all the intermediate elongate pieces and lowermost elongate pieces.

14. The modular Christmas tree of claim 1, wherein the uppermost elongate pieces share a common design that, optionally, is the same as all the intermediate elongate pieces and/or lowermost elongate pieces.

15. The modular Christmas tree of claim 1 wherein, for each side structure, the series of joined elongate pieces alternate between elongate pieces directly supported by a support structure and elongate pieces not directly supported by a support structure.

16. The modular Christmas tree of claim 15, wherein each side structure comprises:

three intermediate elongate pieces, and the modular Christmas tree comprises one lower central support structure;

five intermediate elongate pieces, and the modular Christmas tree comprises two lower central support structures; or seven intermediate elongate pieces, and the modular Christmas tree comprises three lower central support structures.

17. The modular Christmas tree of claim 1, wherein the hubs, spokes and elongate pieces are made from wood.

* * * * *